US006305715B1

(12) United States Patent
Lawrence

(10) Patent No.: US 6,305,715 B1
(45) Date of Patent: Oct. 23, 2001

(54) PROOFING SUBSTRATE AND METHODS OF MANUFACTURE AND USE

(76) Inventor: Eric R. Lawrence, 13 Oakland St., Mattapoisette, MA (US) 02739

( * ) Notice: Subject to any disclaimer, the term of this patent is extended or adjusted under 35 U.S.C. 154(b) by 0 days.

(21) Appl. No.: 09/301,631

(22) Filed: Apr. 29, 1999

(51) Int. Cl.[7] ..... B42D 15/00
(52) U.S. Cl. ..... 283/61; 430/143
(58) Field of Search ..... 430/143, 293, 430/950, 257, 252, 253, 258; 283/61, 62, 101, 105

(56) References Cited

U.S. PATENT DOCUMENTS 4,260,673 * 4/1981 Krech ..... 430/143
4,376,159 * 3/1983 Spechler ..... 430/293
5,020,356 6/1991 Dukes ..... 73/1
5,380,620 * 1/1995 Namiki et al. ..... 430/257
5,524,998 6/1996 Schwartz ..... 402/79
5,671,006 9/1997 Billiot ..... 347/262

* cited by examiner

*Primary Examiner*—Willmon Fridie, Jr.
(74) *Attorney, Agent, or Firm*—Fish & Richardson P.C.

(57) ABSTRACT

A proofing substrate includes a proofing sheet layer of a lightweight paper and a carriage layer of a heavier weight paper attached to the proofing sheet. The proofing sheet can be yellow page stock that is used to print "yellow pages" portions of telephone directories. The proofing can alternatively be newsprint paper. The weights of the first and second layers are selected based on an aggregate weight of the two sheets. The carriage layer has a weight selected so that it can feed the proofing substrate through a desktop printer or copier. The proofing substrate has at least one adhesive layer to hold the carriage and the proofing sheet together.

12 Claims, 4 Drawing Sheets

12'FINISHED PROOF SHEET

PROOFING SUBSTRATE AND METHODS OF MANUFACTURE AND USE

BACKGROUND

This invention relates to printing proofs on paper.

Printed materials such as newspapers and telephone directories are printed on lightweight paper. These printed materials often include advertising particularly with graphics. Usually proofs of an advertisement are produced before printing of the final product. These proofs are printed on conventional 50 lb. weight paper from a file that contains a bitmap or other type of digitized representation of the advertising graphics. The proofs are sent to the customer for approval. There may be some rework after the customer examines the proof. After customer approval or acquiesce of the customer, the file that was used to produce the proof or a reworked version of the file is used to print the finished product. When the product is printed there may be some problems in which a customer may seek monetary adjustment.

SUMMARY

According to an aspect of the present invention, a proofing substrate includes a proofing sheet layer of a lightweight paper and a carriage layer of a heavier weight paper attached to the proofing sheet.

The proofing sheet can be yellow page stock that is used to print "yellow pages" portions of telephone directories. The proofing can alternatively be newsprint paper. The proofing sheet can have a weight in a range of about 20 lbs. to 35 lbs, preferably in a range of about 22.5 lbs. to 30 lbs. The color of the paper is selected based on the application of the proofing sheet layer. The carriage layer can have a weight in a range of about 40 lbs to 60 lbs. The weights of the first and second layers are selected based on an aggregate weight of the two sheets. The carriage layer has a weight selected so that it can feed the proofing substrate through a desktop printer or copier. The proofing substrate has at least one adhesive layer to hold the carriage and the proofing sheet together.

According to an additional aspect of the invention, a method of producing proofs of an image for paper printing applications includes printing an image on a proofing sheet portion of a proof substrate.

One or more of the following advantages may be provided by aspects of the invention. The proofing substrate is comprised of two layers, a proofing sheet layer and a carriage layer. Artwork is printed on the proofing sheet, while the carriage layer is used to guide the proofing substrate and in particular the proofing sheet through a printing process. Thus, rather than using conventional photocopy paper to print a proof, the proof is printed on the proofing substrate and in particular the proofing sheet. The proofing sheet can be removed from the proofing substrate leaving the finished proof. The proof is now on the same weight page stock that is used to print the finished product.

The finished proof can be sent to the customer for approval. At this point, however, there is an example of the advertisement as it would appear in a printed book, and it is less likely that there would be any cause to make an adjustment for a dissatisfied customer. Therefore, causes for dissatisfaction can be caught earlier in the process. Moreover, even prior to the stage of initial customer approval, the facility could make adjustments because they may find problems with the proof that would not appear on the conventional proof. Thus, there is opportunity for savings at initial customer approval and post print customer approval stages.

DESCRIPTION

Figures 1, 1A:
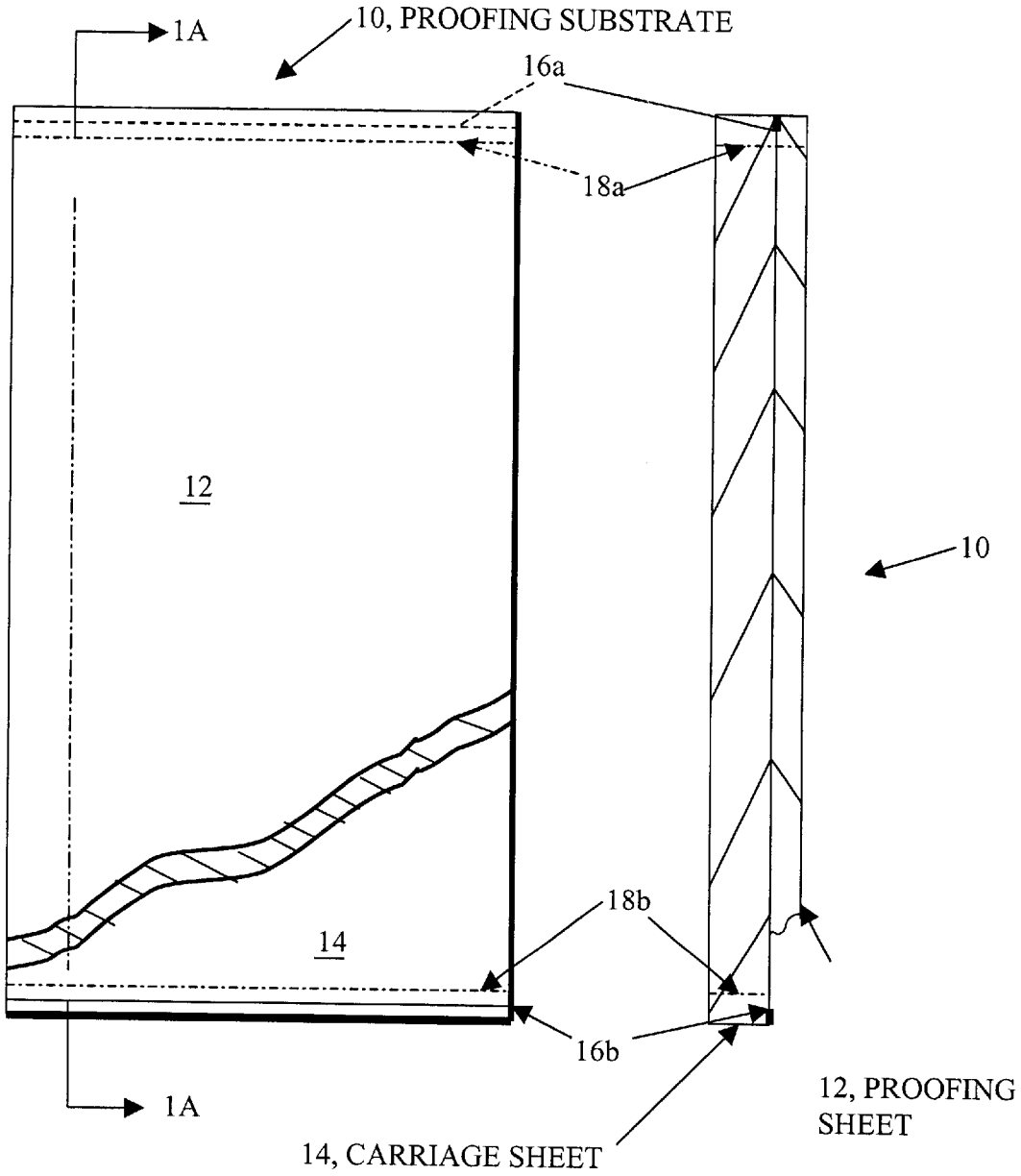
FIG. 1 is a plan view of a proofing substrate.
FIG. 1A is a cross-sectional view of the proofing substrate taken along lines 1A—1A of FIG. 1.

Referring now to FIG. 1, a proofing substrate 10 is shown. The proofing substrate 10 is comprised of two layers. One of the layers is a proofing sheet layer 12 of a lightweight paper. One example of a lightweight paper is 22.5 lbs. weight yellow page stock that is used to print telephone directory books, particularly the "yellow pages" portions of telephone directories. Other applications include newspaper proofs. The proofing sheet 12 can have a weight in a range of about 20 lbs. to 35 lbs. A preferred range is 22.5 lbs. to 30 lbs. Although the color of the paper could be any color, the color is selected based on the application. Thus, for a proofing substrate for the yellow pages, the color would be yellow. For newspapers the color could be white. Other colors could also be used.

Under the proofing sheet layer 12 is a carriage layer 14. The carriage layer 14 is a heavier weight paper which can have a weight in a range of about 40 lbs. to 60 or more lbs. with a preferred example being normal 50 lb. weight paper that is conventionally used in photocopiers. The exact weights of the first and second layers could be selected based on an aggregate weight, that is, a lower weight proofing sheet could be used with a higher weight carriage sheet, as long as the carriage sheet can feed through a desktop printer or copier. The carriage layer 14 acts as a guide that guides the proofing sheet layer 12 through a printer or copier so that graphic work can be printed directly on the proofing sheet i.e., the 22.5 lbs. weight yellow page stock paper.

The substrate 10 also includes at least one and preferably two adhesive layers 16*a*–16*b* at the top and bottom, i.e., horizontal edges of the substrate 10. Examples of the 10 adhesive include a polymer glue, e.g., an acrylic polymer glue microsphere type or dual-sided tape. The only necessary characteristic is that the adhesive layers 16*a*–16*b* hold the two sheets together. The adhesive could be either permanent or temporary type.

Alternatively, the adhesive layers could be along the sides of the substrate (not shown). However, manufacturing considerations may make this arrangement less preferred. The substrate could optionally have a pair of perforated regions 18*a*–18*b* adjacent the two adhesive layers 16*a*–16*b*, respectively, that are provided to permit separation of the two sheets 12 and 14. The perforated regions 18*a*–18*a*are directly adjacent the adhesive layers 16*a*–16*b* so once it goes through the machine the two pieces can be separated with a perforation and that is on 18*a* and 18*b*.

Figure 2:
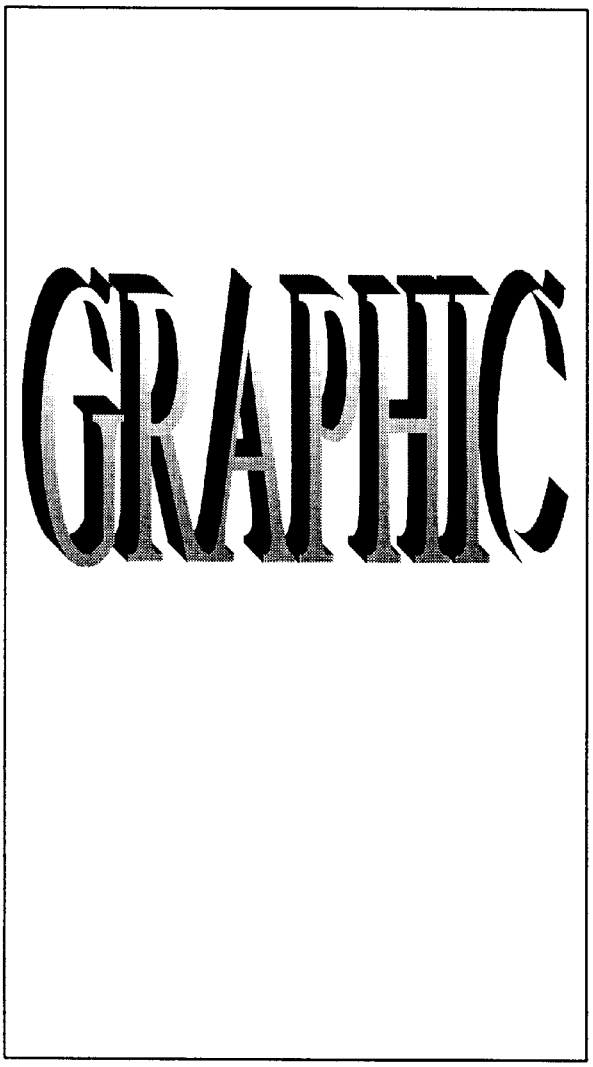
FIG. 2 is a plan view of a finished proof sheet.

Referring now to FIG. 2, a finished proofing sheet 12' separated from the carriage 14 is shown with an artwork 11 printed on it. The finished sheet may have traces of the adhesive and possible one or two ragged edges corresponding to where the optional perforations were on the proofing substrate 10 (FIG. 1).

Figure 3:
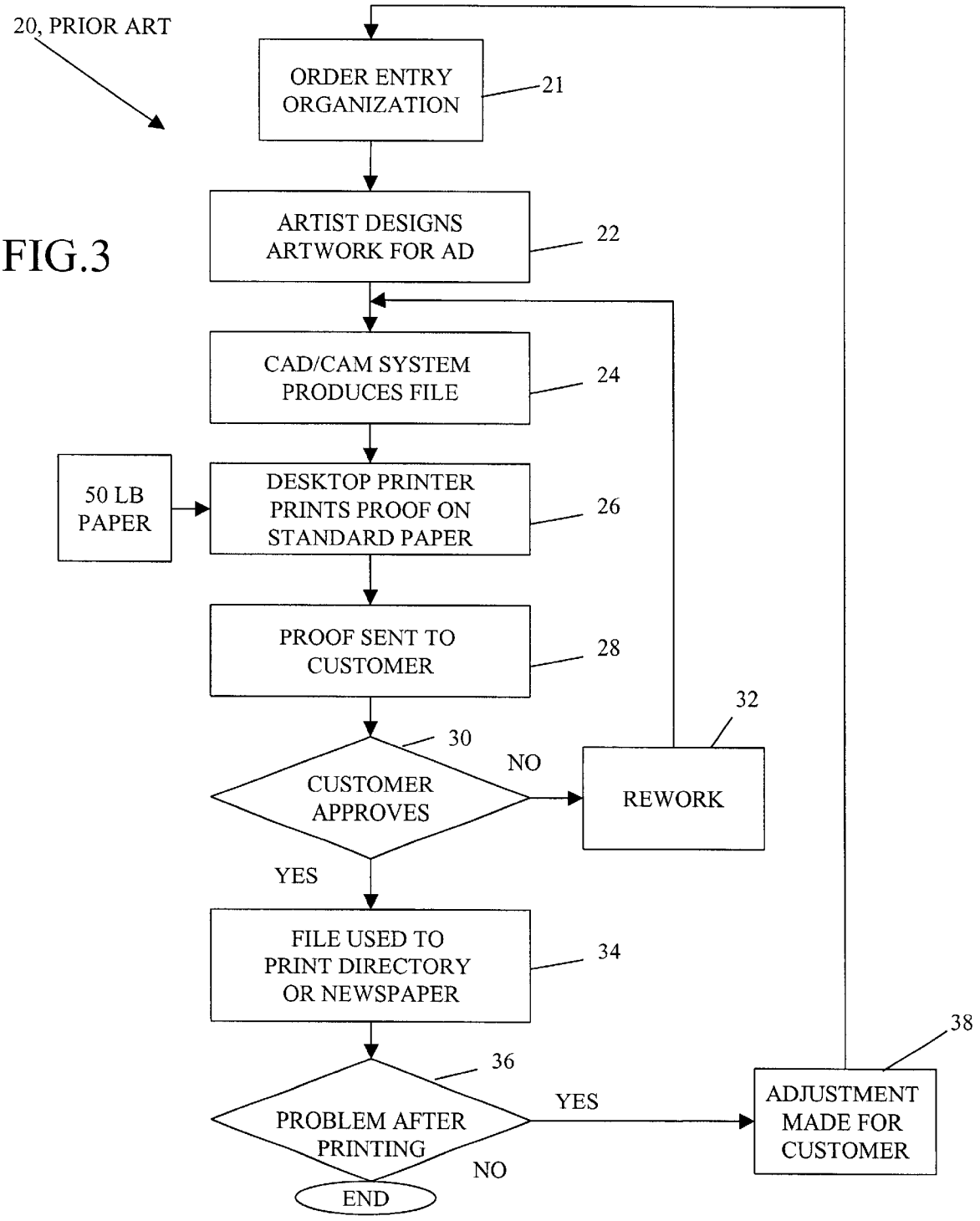
FIG. 3 is a flow chart showing a conventional process for producing a paper proof.

Referring now to FIG. 3, a conventional example of process 20 for supplying an advertising proof to a customer is shown. In the conventional process 20 an order is received 21 for an advertisement. Artwork for the advertisement is designed 22 by an artist. The artist could be in the facility that manufactures the telephone book, or the artwork could be supplied by the customer. The artwork is fed 24 into a desktop publishing system that generates a computer file containing a bitmap or other digital representation of the graphic artwork. The bitmap image file is sent to a desktop printer. The desktop printer is fed by conventional 50 lb. weight photocopy paper. The conventional 50 lbs. weight photocopy paper is used to print 26 a proof. The proof is on the 50 lb. weight paper and is sent 28 to the customer for approval 30. In the customer approval process 30 if the customer approves or does not respond, the proof will be used to print 34 the graphic in a yellow pages directory. If the customer does not approve, the proof is reworked 32. The graphic artwork is sent back to the facility for revision by the graphic artist. The revised artwork is converted into a file and the file is sent 24 to the desktop printer, printed 26 on the 50 lb. weight paper to generate the proof and the proof is sent to the customer.

If the book is printed, and the customer has a problem 36 with the printed product, the customer may look for some sort of claim or adjustment 38 against the company. Often some sort of monetary adjustment is made back to the customer.

The problem with this approach is that 50 weight paper is not what the finished product is. The book is published with 22.5 lbs. weight paper. Therefore, if proofs are produced on 50 lbs. weight paper color, clarity, bleeding, and other problems that may occur when printed in the yellow pages may not appear on the 50 lbs. weight paper because of the differences between characteristics of the different papers. These differences include differences in weight, thickness and texture. Thus, a proof that is produced on the 50 lb. weight paper may be acceptable. When the graphic work goes through the printing process, there could be many problems, in particular, when its actually printed on the lighter weight paper. One common problem is bleeding of the image.

Figure 4:
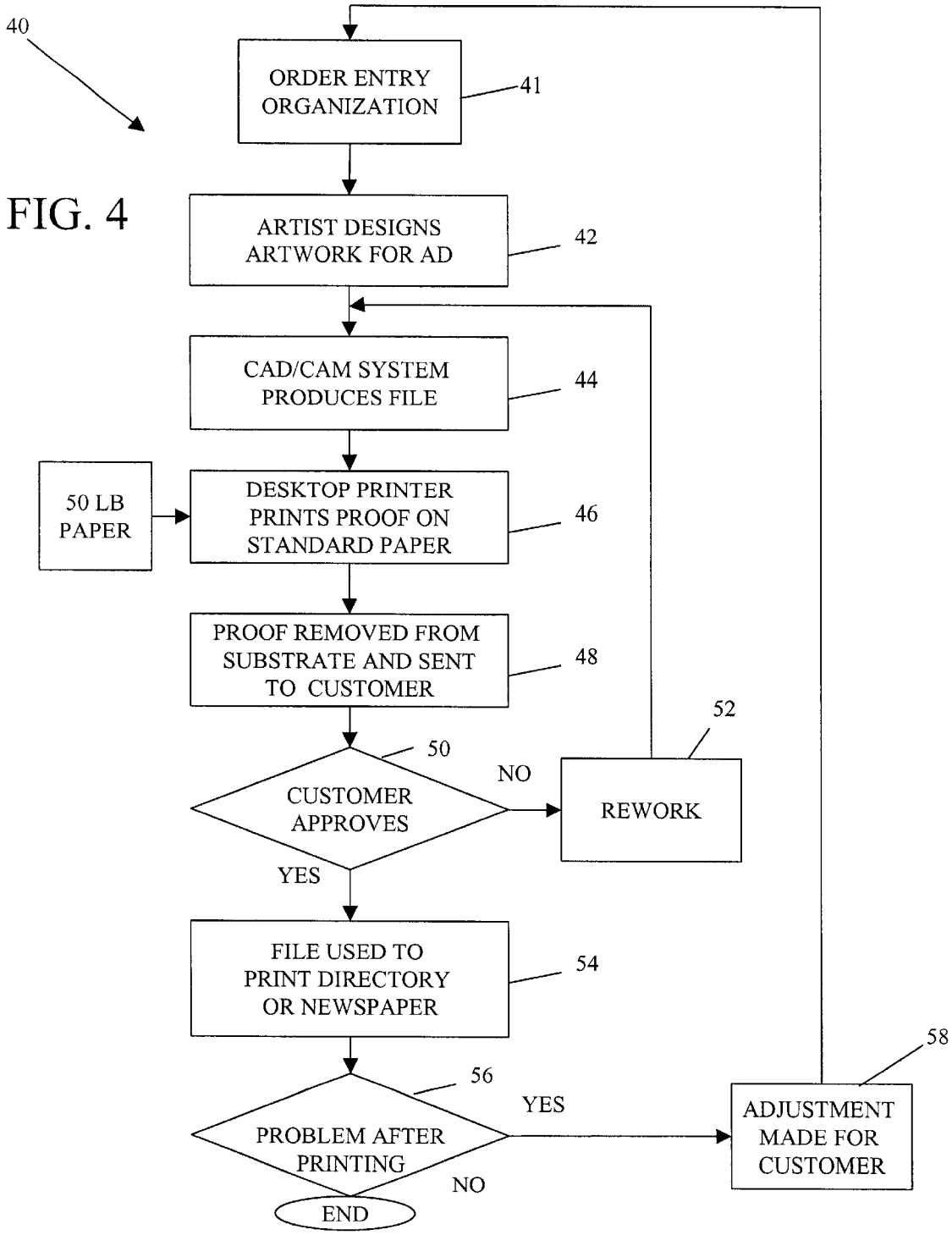
FIG. 4 is a flow chart showing a process for using the proofing substrate of FIG. 1 to produce the finished proof of FIG. 2.

Referring now to FIG. 4, an example of a process 40 that uses a proofing substrate 10 to supply an advertising proof to a customer is shown. In process 40 an order is received 41 and from the order, an advertisement is designed 42 by an artist. The artist could be in the facility that manufactures the telephone book, or the artwork could be supplied by the customer, as above. A desktop publishing system generates 44 a computer file containing a bitmap or other digital representation of the graphic artwork. The bitmap image file is sent to a desktop printer. The desktop printer is fed by proofing substrate 10. The proofing substrate 10 is comprised of two layers, the proofing sheet layer 12 comprised of paper with a weight in a range of about 20 lbs. to 35 lbs. and the carriage layer 14. The artwork is printed 46 on the proofing sheet 12. The carriage layer 14 guides the proofing substrate 10 and in particular the proofing sheet 12 through the photocopier or desktop printer. Thus, rather that using conventional photocopy paper to print a proof, the proofing substrate 10 and, in particular, the proofing sheet 12 is used to print the proof. The proofing sheet can be removed from the substrate 10 leaving the finished proof 12'. The proof 12' is now on the same 22.5 lbs. weight yellow page stock that is used to print telephone directory books, particularly the "yellow pages" portions of such telephone directories. For other applications such as newspaper proofs, corresponding newsprint paper would be used for the proofing sheet 12 as part of the proofing substrate 10.

The finished proof 12' is sent to the customer for approval 50. In the customer approval process 50 if the customer approves or does not respond, the file from which the proof 12' was produced can be used to print 54 the artwork for an advertisement in a yellow pages directory. If the customer does not approve, the file from which the proof 12' was produced is reworked 52. The graphic artwork is sent back to the facility for revision by the graphic artist. The graphic artist will make changes or revisions. The revised artwork is converted into a file and the file is sent to the desktop printer, printed on the proofing substrate 10 to generate the proof and the proof is sent to the customer.

At this point, however, since there is an example of the advertisement as it would appear in a printed book, e.g., the yellow pages, if the book is printed, it is unlikely that there would be any cause to make an adjustment 56 for a dissatisfied customer. That dissatisfaction can be caught earlier in the process. Moreover, even prior to the stage of the initial customer approval, the facility could make adjustments because they may find problems with the proof 12' that would not have appeared on the conventional proof made on the 50 lb. weight paper.

Thus, there is opportunity for savings in both approval loops, initial customer approval and post print customer approval. The proof 12' does not have differences in weight, thickness and texture from the finished product. Thus, whatever problems appear on proof 12' would have also appeared in the finished product but now are far more likely to be detected prior to printing than when the proof is produced on the 50 lbs. weight.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A proofing substrate comprises:

a proofing sheet layer of a lightweight paper having a weight in a range of about 20 lbs. to 35 lbs; and a carriage layer of a heavier weight paper has a weight in a range of about 40 lbs to 60 lbs attached to the proofing sheet, wherein the carriage and the proofing sheets are attached along at least one edge of the carriage and the proofing sheet.

2. The proofing substrate of claim 1 wherein the proofing sheet is yellow page stock that is used to print "yellow pages" portions of telephone directories.

3. The proofing substrate of claim 1 wherein the proofing sheet is newsprint paper.

4. The proofing substrate of claim 1 wherein the proofing sheet 12 has a weight in a range of about 22.5 lbs. to 30 lbs.

5. The proofing substrate of claim 1 wherein the color of the paper is selected based on the application of the proofing sheet layer.

6. The proofing substrate of claim 1 wherein the carriage layer has a weight of about 50 lbs.

7. The proofing substrate of claim 1 the weights of the first and second layers are selected based on a desired aggregate weight of the two sheets.

8. The proofing substrate of claim 1 wherein the carriage layer has a weight selected so that it can feed the proofing substrate through a desktop printer or copier.

9. The proofing substrate of claim 1 wherein the sheets are attached by at least one adhesive layer to hold the carriage and the proofing sheet together.

10. The proofing substrate of claim 9 wherein the at least one adhesive layer is disposed between the carriage and the proofing sheets along a pair of edges of the carriage and the proofing sheets.

11. The proofing substrate of claim 1 wherein the sheets are attached by an adhesive layer disposed between a pair of edges of the proofing substrate to hold the carriage and the proofing sheets together.

12. The proofing substrate of claim 11 wherein the sheets are attached by a perforated region disposed along edges of the sheets.

* * * * *